US005498041A

United States Patent [19]

Bezzerides et al.

[11] Patent Number: 5,498,041

[45] Date of Patent: Mar. 12, 1996

[54] GATE LATCH ASSEMBLY

[75] Inventors: James Bezzerides, 1643 Gamay St., Santa Rosa, Calif. 95403; Oscar W. Lux, III, 1635 Tahoe Dr., Santa Rosa, Calif. 95405

[73] Assignees: James Bezzerides; Oscar W. Lux, III; Clyde Wiggins, all of Santa Rosa, Calif.

[21] Appl. No.: 97,559

[22] Filed: Jul. 26, 1993

[51] Int. Cl.[6] ..... E05C 3/16

[52] U.S. Cl. ..... 292/225; 292/235

[58] Field of Search ..... 292/225, 238, 292/228, 210, 341.15, 341.17, DIG. 29, 235, 133, 219, 285, DIG. 53, 202

[56] References Cited

U.S. PATENT DOCUMENTS

| | | | |
|---|---|---|---|
| 1,233,674 | 7/1917 | Kirsch . | |
| 2,579,621 | 12/1951 | Smith . | |
| 3,266,831 | 8/1966 | Banse . | |
| 3,433,518 | 3/1969 | Foltz . | |
| 4,083,591 | 4/1978 | Parisien . | |
| 4,254,975 | 3/1981 | Miller | 292/341.17 |
| 4,305,611 | 12/1981 | Robins | 292/238 |
| 4,482,175 | 11/1984 | Sugie | 292/198 |
| 4,690,440 | 9/1987 | Rogers | 292/228 |
| 4,932,693 | 6/1990 | Schwartz | 292/228 |
| 4,938,508 | 7/1990 | Thomas . | |
| 4,989,908 | 2/1991 | Futch et al. | 292/341.15 |
| 4,993,759 | 2/1991 | Thomas . | |
| 5,078,438 | 1/1992 | Bieganski . | |
| 5,116,090 | 5/1992 | Nichandros | 292/236 |

FOREIGN PATENT DOCUMENTS

| | | | |
|---|---|---|---|
| 31243 | 6/1979 | Australia | 292/254 |
| 1046552 | 1/1979 | Canada | 292/133 |

*Primary Examiner*—Steven N. Meyers
*Assistant Examiner*—Monica E. Millner
*Attorney, Agent, or Firm*—Malcolm B. Wittenberg

[57] ABSTRACT

A gate latch assembly which includes a latch bar fixedly attached to a swingable gate is received into a slot in a latch frame. The latch frame is fixedly attached to a gate post enabling the gate to swing from the gate post upon the actuation of pawl releasing the latch bar. A number of modifications have been made to the standard gate latch assembly in order to improve its overall function and usability.

8 Claims, 7 Drawing Sheets

GATE LATCH ASSEMBLY

TECHNICAL FIELD OF THE INVENTION

The present invention relates to a gate latch assembly including a latch bar which is received in a slot in a latch frame. Although gate latch assemblies of the type disclosed herein have been extensively employed as closure devices for wooden swingable gates, prior configurations have proven somewhat inadequate as they require constant maintenance and periodic replacement.

BACKGROUND OF THE INVENTION

Gate latch assemblies of the type disclosed herein have been in constant use for quite some time. A typical assembly of this type is shown in U.S. Pat. No. 3,266,831 whereby a latch bar is fixedly mounted on a gate. The gate is latched or held closed by positioning the latch bar in a slot in a frame while engaging the latch bar with a pawl which is similarly mounted on the frame. The latch bar and gate are then retained by the pawl against movement relative to the frame and gate post. When the gate is to be opened, the latch pawl is pivoted upwardly to release the latch bar from movement relative to the gate post.

Prior art assemblies have experienced certain difficulties which are inherent in such configurations. For example, U.S. Pat. No. 3,433,518 notes that after a gate has been hung and then begins to sag or droop relative to a gate post, the latch assembly ceases to function adequately as the latch bar and slotted frame cease to be in alignment. The referenced patent attempts to solve this problem by exaggerating the width of the slot in the latch frame to such an extent that it will accept a latch bar even when the latter is appended to a grossly misaligned gate and post assembly.

There are, however, additional shortcomings inherent in such gate latch assemblies of the prior art. For example, misalignment of the latch bar and latch frame occurs not only as a result of a sagging gate but also as a result of various attachment means pulling loose from post and gate elements as a result of the repeated use of the subject gate latch assembly. This is a particularly acute problem when these assemblies are functionally connected to redwood and other soft wooden members.

Prior gate latch assemblies also generally rely upon gravity to bias the latching pawl to secure an appropriate latch bar. When a pull cord is provided through the gate post, latch assemblies, which have been exposed to varied weather conditions and foreign debris do not operate as smoothly as corresponding new assemblies. As a result, parts which are biased merely by gravity tend to resist movement resulting in the failure to appropriately latch the gate to the post without the user having to positively engage the pawl with the latch bar. Once the pull cord is actuated, a weathered gate latch assembly may not adequately release the latch bar and the user may be forced to reach over the gate itself to physically pull the latch bar from the latch frame.

Virtually no prior gate latch assemblies allow the user to actuate the assembly employing a pull cord without need for the use of one's hands. Oftentimes, users approaching a gate are carrying objects which prevent them from using their hands to actuate the gate latch assembly. Even if this were not a problem, prior assemblies, particularly those which have been in service for some time, do not encourage the latch bar's release from the latch frame and, as such, the user must not only pull an appropriate actuating cord but simultaneously push the gate forward prior to release of the latching pawl or the latch bar would simply be recaptured by the pawl and remain within the latch frame.

Finally, a major deficiency in virtually all prior gate latch assemblies is the failure over time for the latch bar and slot in the latch frame becoming misaligned. As noted previously, this deficiency was recognized and dealt with in U.S. Pat. No. 3,433,518 by increasing the width of the slot so that even grossly misaligned latch bars will be accepted by the latch frame. However, this solution has proven to be grossly inadequate as such configuration lacks the precision deemed desirable in any gate latch assembly.

It is an object of the present invention to provide a gate latch assembly for releasably holding a gate in a closed position relative to a gate post while improving over corresponding assemblies of the prior art.

It is yet another object of the present invention to provide a gate latch assembly for releasably holding a gate in a closed position relative to a gate post while remedying the various deficiencies recited above and which characterize virtually all prior designs.

These and other objects and features of the invention will become more apparent when considering the following detailed description, taken in connection with the accompanying drawings wherein.

SUMMARY OF THE INVENTION

Figure 1:
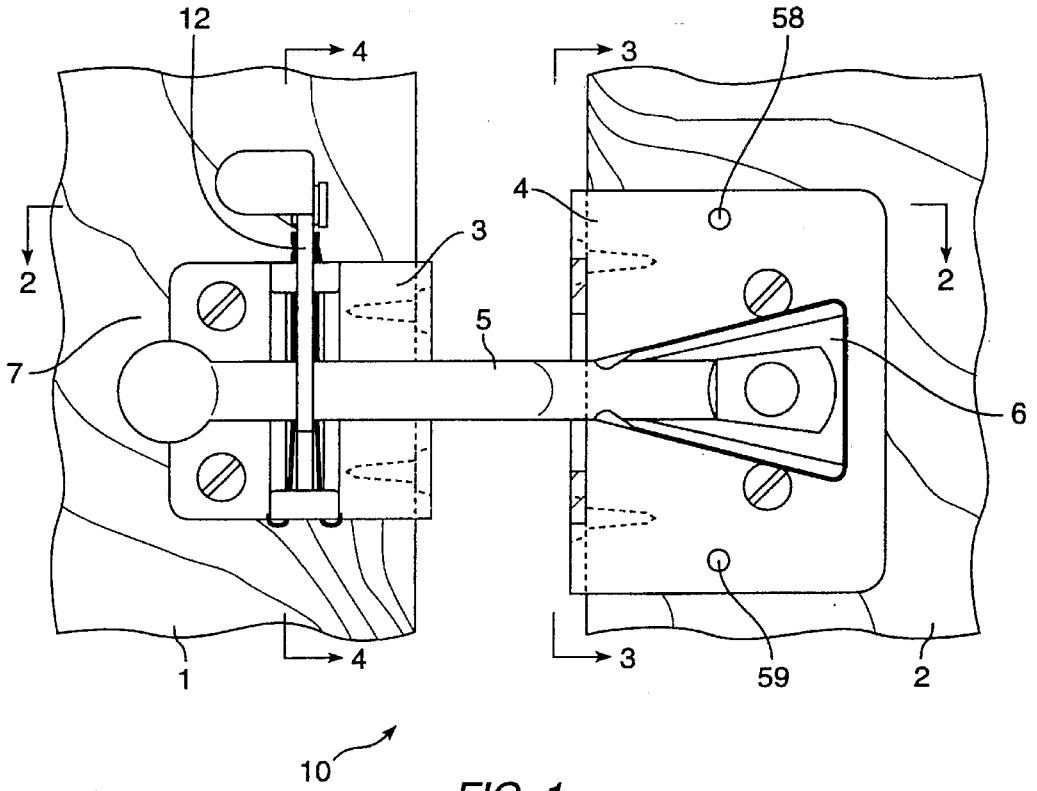
FIG. 1 is a plan view of the gate latch assembly of the present invention.

The present invention deals with a gate latch assembly for releasably holding a gate in a closed position relative to a gate post. The latch assembly comprises a latch bar, connecting means adapted to connect the latch bar to the gate so that the latch bar extends beyond the free edge of the gate. A latch frame is provided including connecting means adapted to connect the latch frame to the gate post. The latch frame includes an outwardly opening slot into which the latch bar is received when the gate is in a closed position. A pawl is provided which is pivotally connected to the latch frame and which includes an outwardly facing cam surface to be engaged by the latch bar causing the pawl to pivot upwardly when the gate is moved to a closed position. The pawl includes a recessed opening to receive the latch bar as the pawl is pivoted upwardly upon movement of the latch bar into the outwardly opening slot in the latch frame. The recessed opening of the pawl is defined along one side by a wall surface thereof traversing the slot in the latch frame when the gate is closed to trap the latch bar in the slot.

The present invention includes a number of improvements over corresponding prior devices. The improvements include providing as part of the recessed opening of the pawl, a cam surface such that when the gate latch is in a closed position and the pawl is caused to pivot upwardly, the latch bar is nudged outwardly from the opening slot of the latch frame. Spring means are provided between the pawl and the latch frame such that the pawl is biased downwardly to resist pivoting in response to contact between the pawl and latch bar. In addition, spring means are provided in contact with the latch bar such that the latch bar, although being capable of deviating from a horizontal orientation, is biased to assume such an orientation.

It is proposed that the latch bar connecting means and the latch frame connecting means comprise connecting plates having two planar faces at right angles to each other such that the connecting plates are capable of being removably attached at two faces of the gate and gate post, respectively.

It is contemplated that the pawl be functionally attached to a cable which passes through an appropriate gate post and is connected to a bell crank at a distal end thereof. With such a configuration, when pressure is applied to one end of the bell crank, it is caused to pivot about a fulcrum which, in turn, raises the pawl to release the latch bar. As a preferred embodiment, the connecting yoke and cable are characterized as having approximately the same diameter to prevent hang-up of the cable assembly at a shoulder created by providing the pass-through opening for the cable to the bell crank.

Finally, the present invention contemplates a further embodiment whereby the latch bar is connected to an appropriate gate post and the latch frame to a gate to enable the gate to open in a direction opposite to that provided by the embodiments previously discussed.

DETAILED DESCRIPTION OF THE INVENTION

Turning to FIG. 1, gate latch assembly 10 is shown as functionally connecting gate post 1 with gate 2. Prior to discussing the details of the present invention, an overall functionally description of the manner in which the component parts cooperate will be provided.

Figure 4:
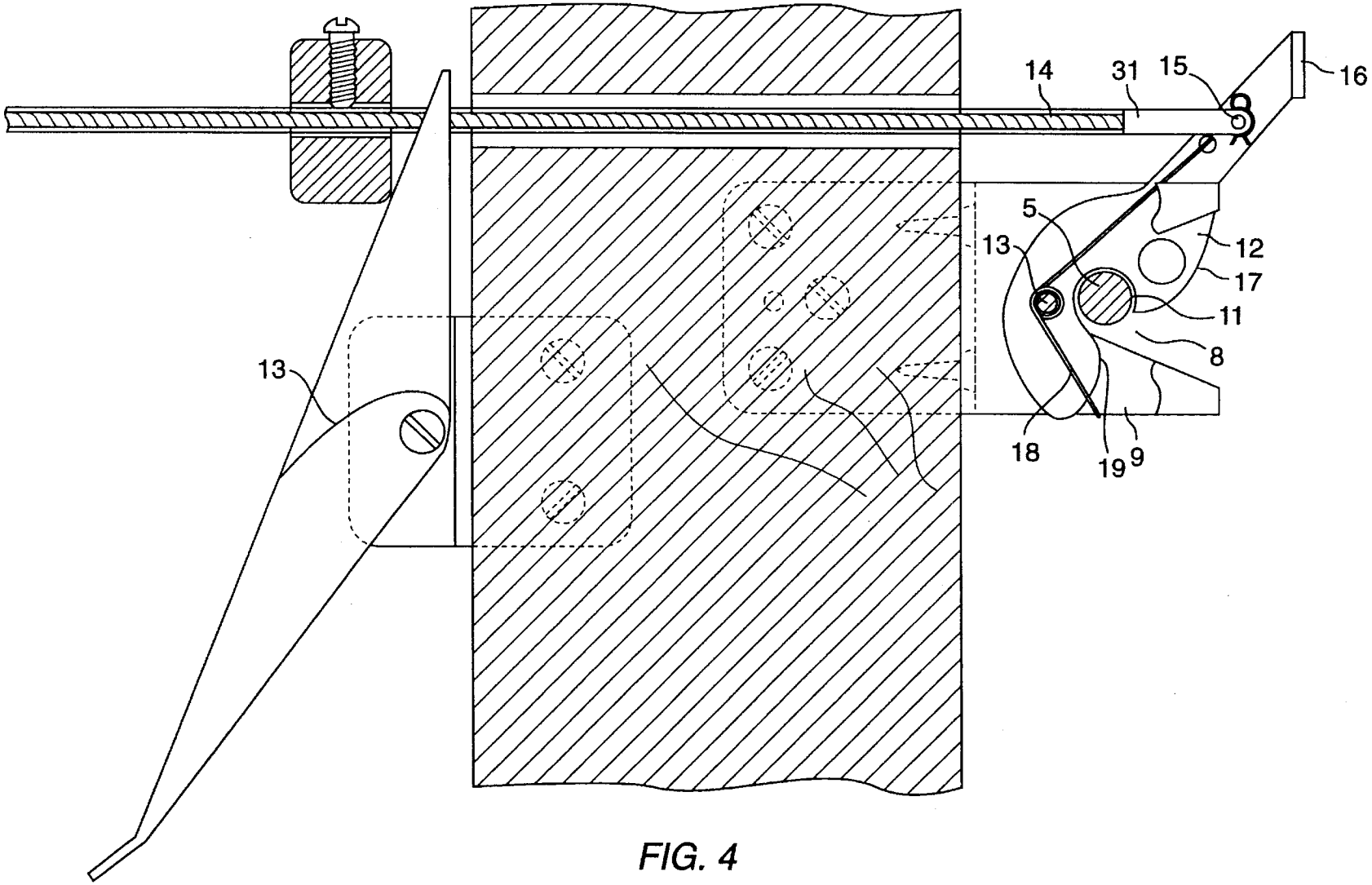
FIG. 4 is a cross-sectional view of the gate latch assembly of the present invention taken along line 4—4 of FIG. 1.

Gate 2 will be retained in a closed position, as shown in FIG. 1, by the latch assembly 7 when latch bar 5 extends into slot 8 of latch frame 9 and within recess 11 of pawl 12 (FIG. 4). A force tending to swing the gate open will result in pressure being applied to pawl 12 by latch bar 5 which will then exert an outward force on pivot pin 13 and a moment or turning action on pawl 12 which will create a force tending to pivot pawl 12 about pin 13. This outward force will be resisted by the pivot pin as well as by the pawl itself. When cord 14 is pulled by a person standing on the far side of the gate, or when release lever 16 of the pawl is manually grasped to pivot the pawl counterclockwise about connector pin 13, latch bar 5 and gate 10 will be released for movement from the closed position of FIGS. 1 and 4 to an open position. The latch bar will then move out of engagement with slot 8 and recess 11.

When the gate is swung back to a closed position, latch bar 5 will engage cam surface 17 to pivot pawl 12 upwardly to enable the latch bar to clear the pawl. Prior designs call for the gravitational drop of the pawl back to its closed position as shown in FIG. 4. However, the present invention contemplates the use of spring means 18 provided between the pawl and latch frame such that the pawl is biased downwardly to resist pivoting in response to contact between the pawl and latch bar. In the closed position, recess 11 and slot 8 circumscribe the engaged portion of latch bar 5 to retain the latch bar against outward movement from the position shown in FIG. 4.

By providing spring means 18 between pawl 12 and latch frame 9, even those latch frame assemblies which have been exposed to severe weather conditions for prolonged periods as well as those in which foreign matter has compromised pivoting of the pawl at pin 13 will positively engage latch bar 5. Without the use of biasing spring 18, it has been observed that upon the closure of gate 2, the pawl which has been lifted as a result of engagement between latch bar 5 and cam surface 17 oftentimes will not drop into a locked position as shown in FIG. 4 without some type of nudging or encouragement by the user. This is not only inconvenient, but, in the event that the user forgets to encourage closure of pawl 12 over latch bar 5, the gate may remain inadvertently in an open condition defeating the purpose for the gate latch assembly.

Figure 6:
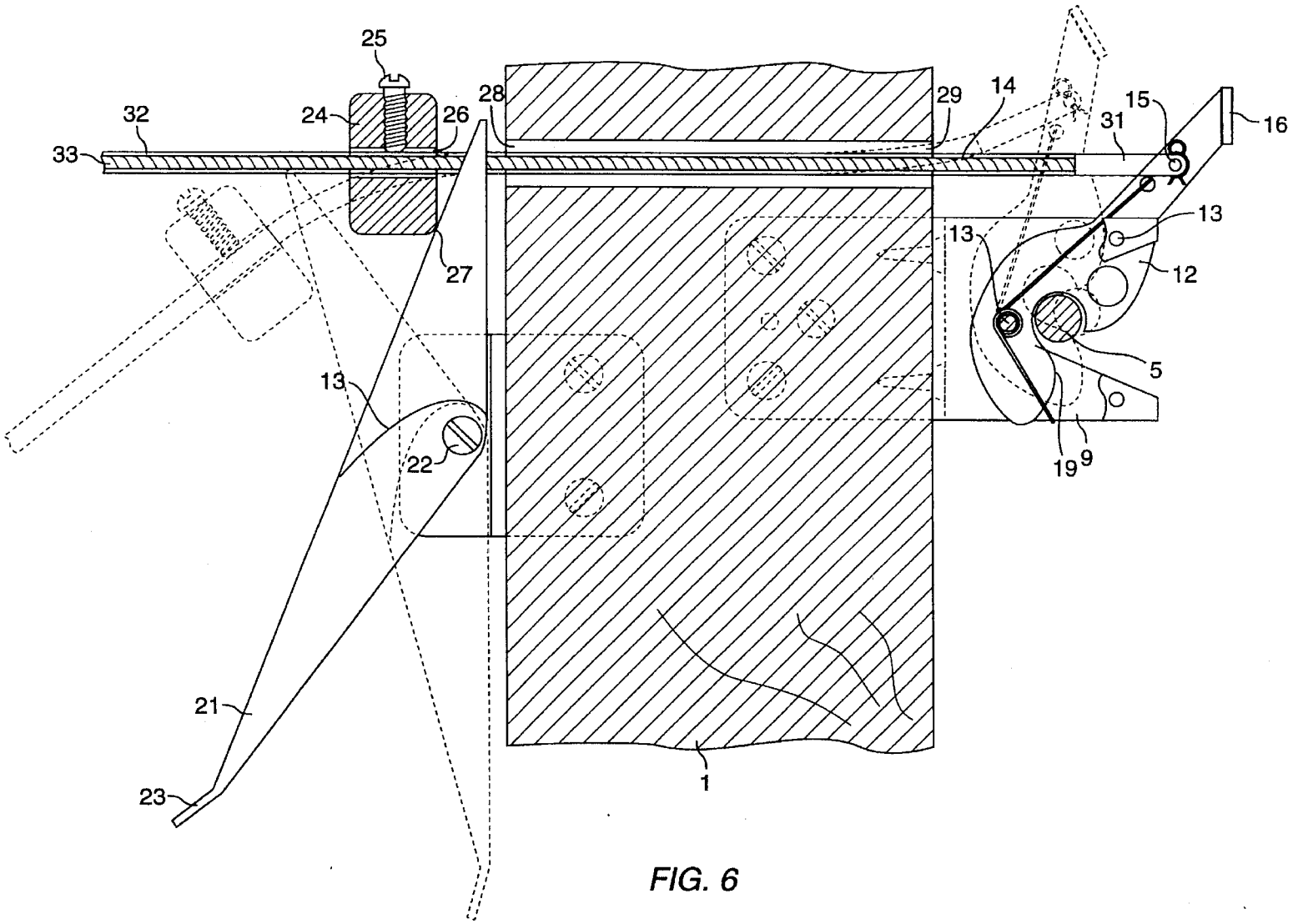
FIG. 6 is a cross-sectional view of the gate latch assembly as shown in FIG. 4 depicting the actuation of the latching pawl through movement of an appropriate bell crank.

Yet a further embodiment to the present invention can be readily appreciated when reference is made to FIG. 6 which shows release of latch bar 5 from latch frame 9 in phantom as a result of either the pulling of draw cord 14 through pivot 15 or by actuation of release lever 16. Prior gate latch assemblies do nothing to encourage positive movement of latch bar 5 from pawl recess 11 or latch frame slot 8. As such, not only must the pawl be rotated in a counterclockwise direction as shown by phantom in FIG. 6 but the gate itself must be pushed or pulled to swing the gate from alignment with gate post 1. The present invention, however, contemplates, as a preferred embodiment, the use of cam surface 19 of pawl 12 such that when the gate is in a closed position and the pawl is caused to pivot about pin 13 in an upward direction, latch bar 5 is nudged outwardly from opening slot 8 of latch frame 9. As such, one is capable of opening gate 2 simply by actuating pawl 12 which can be done without the intervention of hand actuation.

In continuing to refer to FIG. 6, pawl 12 can be moved from its closed position to an open configuration shown in phantom by pivoting bell crank 21 about pivot 22 to its phantom position. This can be done by simply putting pressure on bell crank distal end 23 by simply leaning against distal end 23 with one's body or perhaps an elbow providing for actuation of the present gate latch assembly even when the user is carrying objects and is thus unable to provide a free hand to open gate 2 from its closed position. As a preferred embodiment, bell crank 21 can be biased to a closed position by spring means 18 as shown in FIGS. 4 and 6.

In accommodating gate posts of varying thicknesses, it is contemplated that adjustment knob 24 be provided. In operation, cable 14 passing through opening 28 of post 1 is further caused to pass through opening 26 of adjustment knob 24. Set screw 25 is loosened so that cable 14 can pass through opening 26. Knob 24 is then moved along cable 14 until contact is made between knob 24 and bell crank 21 at pivot point 27. Once cable 14 is drawn taut through passageway 28, set screw 25 is tightened such that movement of bell crank 21 through fulcrum 22 will move pawl 12 in a counterclockwise direction shown by phantom in FIG. 6.

As a consequence of creating passageway 28 within post 1, shoulder 29 is created. It has been found that unless care is taken in fabricating cable 14, during the operation of the present gate latch assembly, a hang-up condition can exist whereby cable 14 and yoke 31 will resist movement within passageway 28 over shoulder 29. Such a condition can be avoided by providing cable 33 with an outer sheath of plastic 32 such that the outer diameter of cable 14 is the same as the outer diameter of connecting yoke 31.

Figure 8:
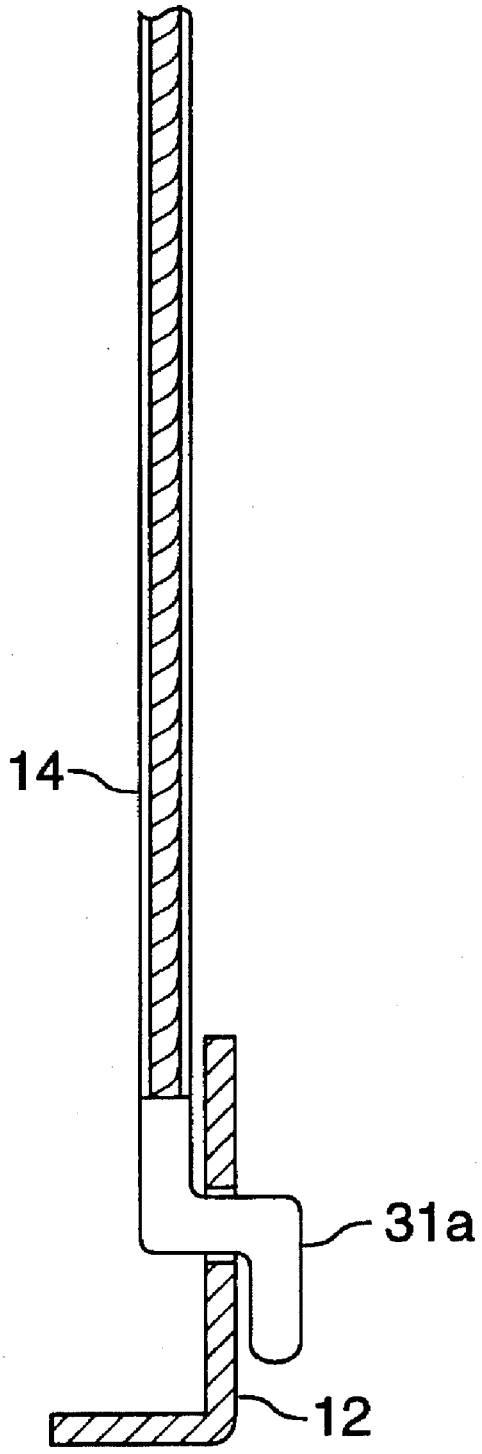
FIG. 8 is a top plan view showing an alternative embodiment of connector means between the pull cable and pawl of the present invention.

Connecting yoke 31 can be altered as shown in FIG. 8 while remaining within the scope of the present invention. For example, cable 14 can be configured with S-shaped distal end 31*a* unitarily connected to the cable wire core. S-shaped distal end 31*a* is caused to fit within an opening in pawl 12 in place of pivot pin 15 and will remain in place fixedly attaching cable 14 to pawl 12 until positive action is taken to remove distal end 31*a* from pawl 12.

As noted previously, a major difficulty in employing gate latch assemblies of prior design results from misalignment of latch bar 5 with latch frame opening 8. If a single set screw was to be employed to maintain latch bar 5 onto gate 2 as many prior configurations contemplate, latch bar 5 would quickly loosen at its pivot point and droop from a preferred horizontal orientation to one that is either diagonal to or perpendicular to its preferred orientation after a relatively short period of in-service usage. If several screws are employed to maintain the horizontal orientation of latch bar 5, although the drooping characteristic discussed above is substantially eliminated, any misalignment between latch bar 5 and latch frame 9, such as by a drooping or settling gate assembly, will make it very difficult, if not impossible, to enable the latch bar to be received by the latch frame. At that point, the user must remove the latch bar connecting assembly and reposition it to account for the gate's changed position. This is oftentimes difficult, if not impossible, for the changed position may be so slightly removed from the original position that it is not feasible to retap screw holes in the gate assembly.

Figure 5:
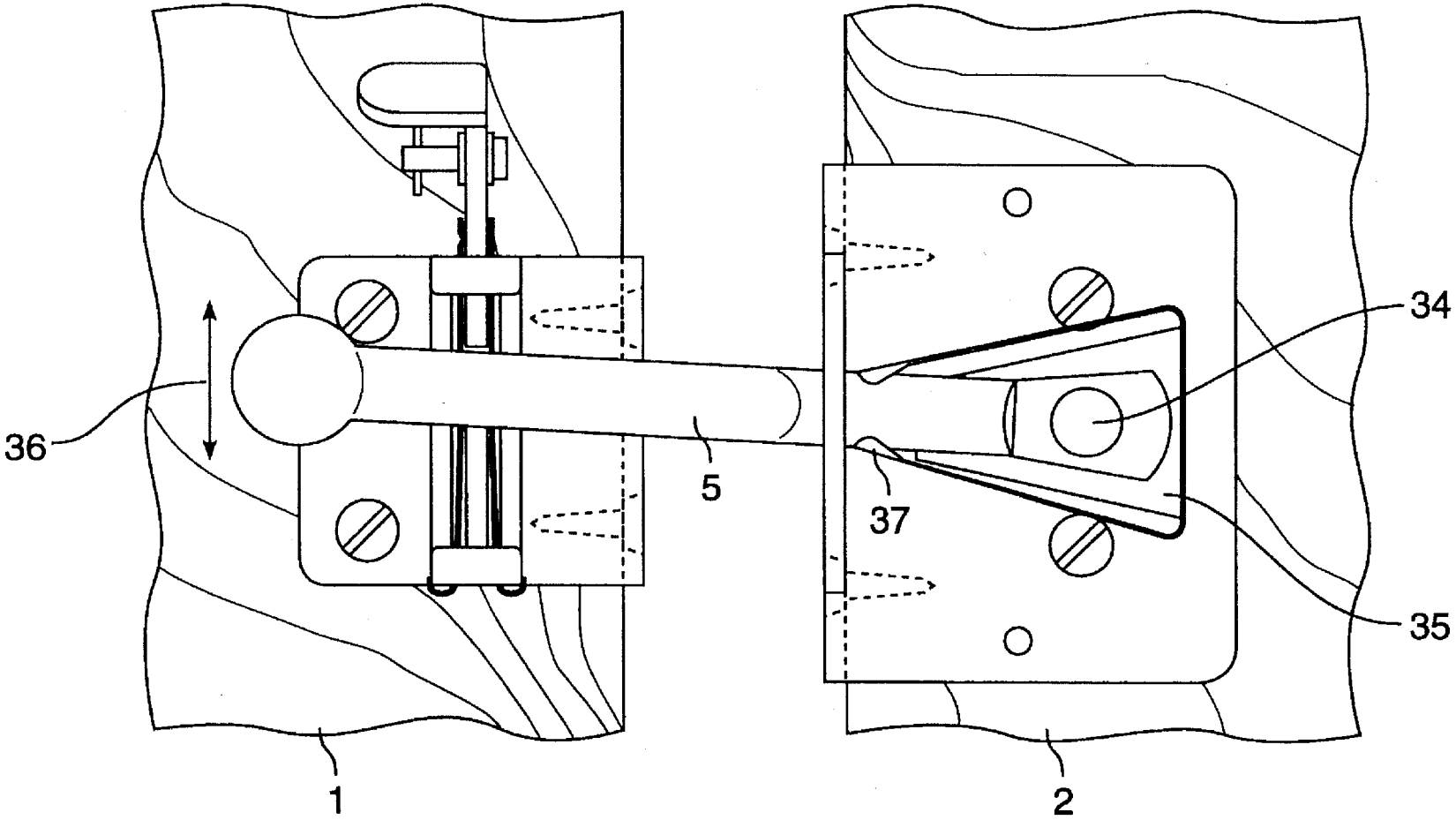
FIG. 5 is a partial plan view of the gate latch assembly of the present invention depicting the spring biasing means of the latch bar.

The above-discussed misalignment difficulty as characterized by prior designs can effectively be eliminated by applicant's preferred embodiment best shown in FIG. 5. Specifically, latch bar 5 is shown connected to gate 2 by single connecting screw or rivet 34. As such, latch bar 5 is capable of pivoting about screw or rivet 34 in order to Compensate for any relative movement between gate 2 and gate post 1. However, spring means 35 is provided in contact with latch bar 5 such that the latch bar is not only capable of deviating from its horizontal orientation as shown schematically by arrows 36 but is biased to assume such a horizontal orientation. Ideally, spring means 35 is configured from a single piece of bent metal stock which includes capture arms 37 for snugly surrounding latch bar 5 as shown in FIG. 5.

As previously noted, one of the shortcomings shared by virtually all prior gate latch assemblies is the eventual loosening and disengagement of the latch bar and latch frame from their supporting gate and gate post. This is a particularly acute problem when the gate latch assembly is applied to a gate structure under constant and repeated usage and when such assemblies are applied to soft wooden members, such as redwood. It has been found that the screws which maintain the latch bar and latch frame quickly loosen and, in extreme cases, various elements actually fall from their wooden support members unless the user is diligent in constantly tightening the various screw elements on a regular and routine basis.

Figure 3:
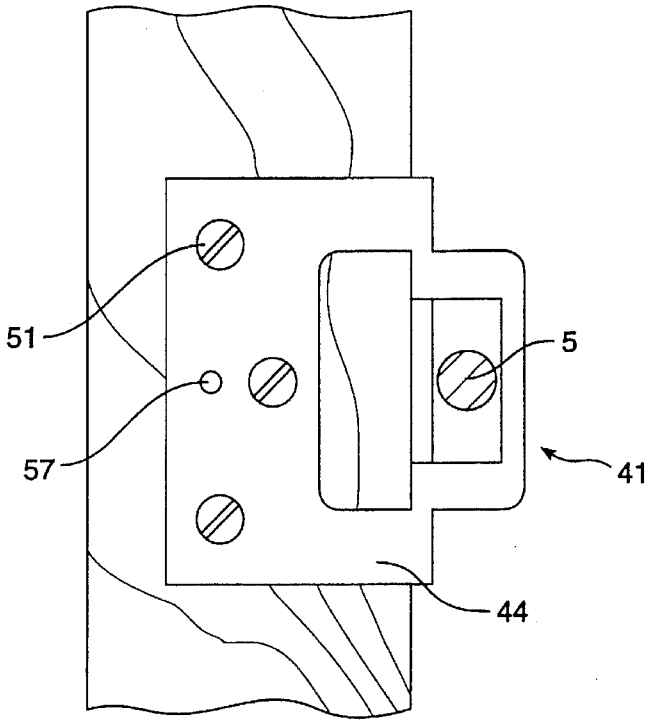
FIG. 3 is a side plan view and partial cross-section of the gate latch assembly of the present invention taken along line 3—3 of FIG. 1.

In overcoming the above-described disadvantage inherent in prior structures, it is now proposed that the latch bar and latch frame employ connecting means 41 and 42 (FIGS. 2 and 3) each having two planar faces at right angles to each other. Specifically, latch bar connecting means 41 is composed of connecting plate 44 and 45 such that the connecting plates are capable of being removably attached to two faces of gate 2 by, for example, screw elements 51 and 52. Similarly, latch frame 12 is provided with connecting means 42 comprising connecting plate 46 and connecting plate 47 at right angles to each other such that the connecting plates are capable of being removably attached to two faces of appropriate gate post 1 by, for example, screws 53 and 54. Attachment being on two faces of the appropriate support member provides previously unequalled resistance to inadvertent loosening and disengagement of the various connecting means for any moment of force tending to loosen the recited connecting means in any one direction would be resisted by a substantially perpendicular screw element passing within the wooden support body.

Figure 2:
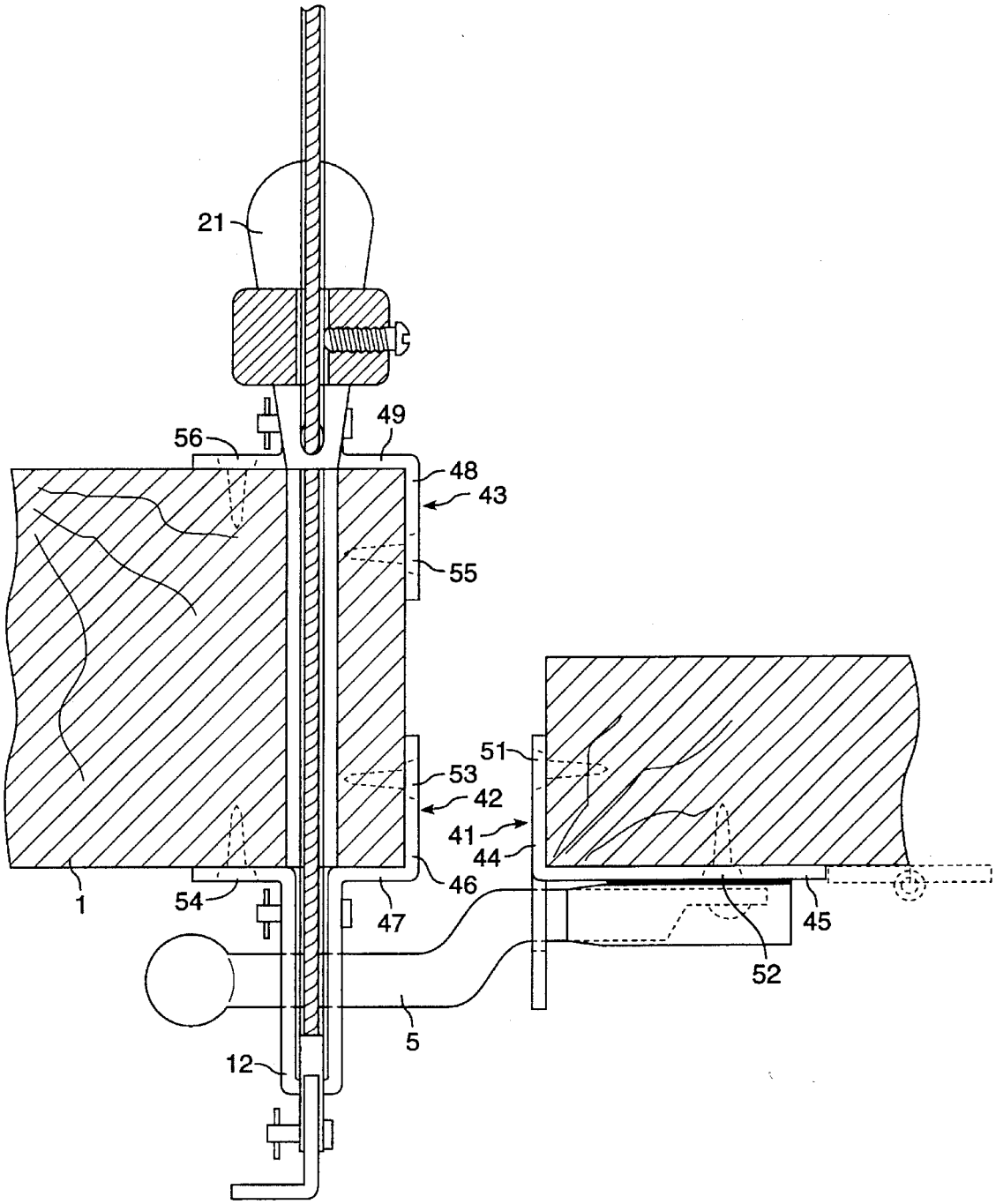
FIG. 2 is a cross-sectional view of the gate latch assembly of the present invention taken along line 2—2 of FIG. 1.

In referring to FIG. 2, the bell crank assembly 21 can further be connected to gate post 1 by connecting means 43 composed of connecting plates 48 and 49 configured at right angles to each other. Once again, the bell crank connecting means can be removably attached to gate post 1 through the use of screw means 55 and 56.

It has been recognized that yet another annoyance inherent in the use of prior gate latch assemblies relates to the installation of the latch bar connecting means and latch frame connecting means. Specifically, it is incumbent that the user properly align the various elements on the gate and gate post and, oftentimes, the elements cannot be secured until screw holes are tapped and the attachment screws themselves sunk within the various wooden members. If, after performing this operation, the user realizes that the elements have not been properly aligned, it may be difficult to make minor adjustments for further screw tabs may be so close to the previously applied holes that proper foundation for the screw connecting means may be non-existent. If the user then attempts to apply the gate latch assembly to a completely different section of the gate and gate post, the previously tapped holes must be filled and cosmetically dealt with.

The above-recited annoyance is substantially eliminated by providing holes 57, 58 and 59 (FIGS. 1 and 3) for pilot nails so that the connecting plates can be positioned on the gate and gate post prior to the drilling of any holes for the application of screw means. Once the pilot nails have been set in place, it is a relatively easy matter to remove them and adjust the various connecting plates until proper alignment is achieved. At that time, the pilot nails can be removed after the application of appropriate screw means or, alternatively, the pilot nails can remain in place indefinitely.

Figure 7:
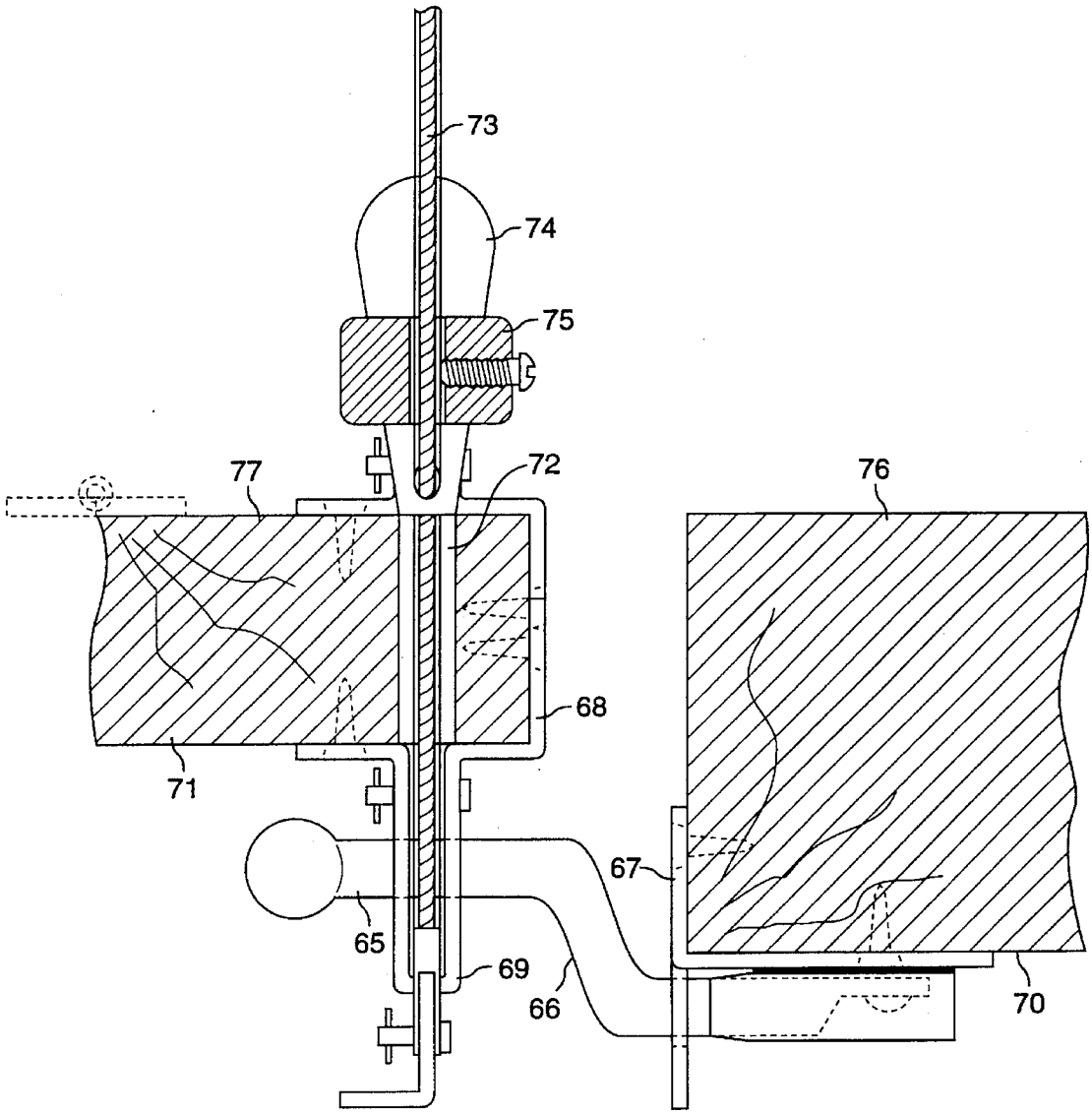
FIG. 7 is a further embodiment of a gate latch assembly of the present invention whereby the latch bar has been secured to an appropriate gate post and latch frame to a corresponding gate.

The discussion up to now has involved the application of a latch bar onto a pivotable gate and a corresponding latch frame onto a set gate post. This results in the swinging of the gate inwardly on the side of the gate supporting the latch bar upon its release from the latch frame and pawl. However, there are instances where a user would have need to swing the gate in an opposite direction. In this regard, reference is made to FIG. 7.

Specifically, latch bar 65 is connected to gate post 70 incorporating, for proper alignment with latch frame 69, S-shaped section 66. By employed S-shaped section 66, faces 76 and 77 of the gate post and gate, respectively, can be properly aligned. As in the previous embodiments, gate latch 65 can be connected to its appropriate supporting wooden member via connecting plate 67 having two planar faces at right angles to each other such that the connecting plate is capable of being removably attached to two faces, in this instance, of the appropriate gate post.

Latch frame 69 is positioned to receive gate latch 66 and is located on gate 71 accordingly. The latch frame 69 and bell crank 74 can be connected to gate 71 through use of a single connecting means 68 which, in this instance, is U-shaped to traverse three sides of gate 71. In addition, passageway 72 can be created within gate 71 so that pull cord 73 can be functionally attached to bell crank 74 through the use of adjustable knob 75. In operation, the bell crank assembly works in the same manner as discussed above with regard to the embodiment of FIG. 6.

While particular embodiments of the present invention have been shown and described, it is obvious to those skilled in the art that changes and modifications may be made without departing from this invention and its broader aspects and, therefore, the aim of the appended claims is to cover all such changes and modifications which fall within the true spirit and scope of this invention.

We claim:

1. In a gate latch assembly for releasably holding a gate in a closed position relative to a gate post, said latch assembly, comprising a latch bar, connecting means adopted to connect the latch bar to said gate so that the latch bar extends beyond a free edge of said gate, a latch frame, including connecting means adapted to connect said latch frame to said gate post, said latch frame, including an outwardly opening slot into which said latch bar is received when said gate is closed, a pawl pivotally connected to said latch frame and including an outwardly facing cam surface to be engaged by said latch bar, causing said pawl to pivot upwardly when the gate is closed, said pawl, including a recess opening to receive the latch bar as the pawl is pivoted upwardly upon movement of the latch bar into the outwardly opening slot in the latch frame, the recess opening of the pawl being defined along one side by a wall surface thereof traversing the slot in the latch frame when the gate is closed to trap the latch bar in the slot, the improvement wherein spring means is provided in contact with said latch bar such that said latch bar, although being capable of deviating from a horizontal orientation, is biased to assume such an orientation.

2. The gate latch assembly of claim 1, wherein said spring means is located at said connecting means for connecting said latch bar to said gate.

3. The gate latch assembly of claim 1 wherein said spring means is configured from a single piece of bent metal stock.

4. In a gate latch assembly for releasably holding a gate in a closed position relative to a gate post, said latch assembly, comprising a latch bar, connecting means adopted to connect the latch bar to said gate so that the latch bar extends beyond a free edge of said gate, a latch frame, including connecting means adapted to connect said latch frame to said gate post, said latch frame, including an outwardly opening slot into which said latch bar is received when said gate is closed, a pawl pivotally connected to said latch frame and including an outwardly facing cam surface to be engaged by said latch bar, causing said pawl to pivot upwardly when the gate is closed, said pawl, including a recess opening to receive the latch bar as the pawl is pivoted upwardly upon movement of the latch bar into the outwardly opening slot in the latch frame, the recess opening of the pawl being defined along one side by a wall surface thereof traversing the slot in the latch frame when the gate is closed to trap the latch bar in the slot, the improvement wherein said pawl is functionally attached to a cable at the proximate end thereof which passes through said gate post and is connected to a bell crank at a distal end thereof such that when pressure is applied to one end of the bell crank, the bell crank is caused to pivot about a fulcrum which, in turns, raises said pawl to release and eject said latch bar.

5. The gate latch assembly of claim 4, wherein the effective length of said cable is capable of being adjusted in order to enable said bell crank to raise said pawl to release said latch bar.

6. The gate latch assembly of claim 4, wherein a yoke or other pivoting mechanical attachment is provided at the proximate end of said cable to pivotally connect said cable to said pawl.

7. The gate latch assembly of claim 6, wherein said yoke and cable are further characterized as having approximately the same diameters.

8. The gate latch assembly of claim 7, wherein said cable comprises a central core of wire coated with a sheath of plastic.

* * * * *